United States Patent [19]

Blanding

[11] 4,141,196

[45] Feb. 27, 1979

[54] SEAL WRAPPING MACHINE

[75] Inventor: Kenneth R. Blanding, Cedar Springs, Mich.

[73] Assignee: Oliver Machinery Company, Grand Rapids, Mich.

[21] Appl. No.: 841,303

[22] Filed: Oct. 11, 1977

[51] Int. Cl.[2] ..... B65B 9/06; B65B 51/26; B65B 61/06

[52] U.S. Cl. ..... 53/550; 53/373; 156/515; 156/583

[58] Field of Search ..... 53/180 R, 182 R, 229, 53/373; 156/515, 583

[56] References Cited

U.S. PATENT DOCUMENTS

| | | | |
|---|---|---|---|
| 2,707,985 | 5/1955 | Binnall | 156/515 |
| 3,028,294 | 4/1962 | Histed | 156/515 |
| 3,473,288 | 10/1969 | Nakamura et al. | 53/182 R |
| 3,866,389 | 2/1975 | Elsner et al. | 53/182 R |
| 4,019,307 | 4/1977 | Ballestrazzi et al. | 53/182 R |
| 4,063,400 | 12/1977 | Millevoi | 53/180 R |

*Primary Examiner*—Robert Louis Spruill
*Attorney, Agent, or Firm*—Price, Heneveld, Huizenga & Cooper

[57] ABSTRACT

A packaging machine wherein an upper film is joined or sealed to a lower film at intervals between spaced articles being advanced on a conveyor, the seal being made by and between a vertically reciprocable, upper, heated, joining element and a cooperative, vertically reciprocable, lower abutment roller element. The abutment roller is at the plane of the conveyor, which is normally an endless belt, with the belt being there diverted around the abutment roller and around a drive roller engaging the abutment roller. The rollers and the heated element are on a carriage which is horizontally reciprocable in one direction with the belt and then back to a return position. The vertical strokes of these elements can be controllably altered during operation of the machine, to accommodate the article size, as can the horizontal stroke of the carriage.

12 Claims, 14 Drawing Figures

SEAL WRAPPING MACHINE

BACKGROUND OF THE INVENTION

This invention relates to a packaging machine and particularly a machine for partially or totally enclosing articles in web stock.

Machines for packaging articles in polymeric or other web stock are well known and widely available. They are primarily used to partially or completely enclose articles in film or web by joining a pair of web panels (which may be the upper and lower layers of a folded web), at the spaces between the articles being advanced. This is typically done by a transverse hot wire or element that shifts vertically to an anvil to seal the web panels. Sometimes the packaged articles are subsequently put through a film shrinkage step. There are machines which perform satisfactorily for this purpose, but such have definite limitations.

One limitation of present equipment is the minimum size of the articles which can be dependably packaged. If the article becomes too small, it will drop into the gap at the sealer or otherwise hang up where the transversely reciprocable sealer and the anvil are located. Another problem area arises because the same area of the anvil is engaged each time, causing eventual wear thereof with consequential defective sealing.

Another limitation involves the complexity of handling articles of different sizes. Changeover of available machines to packaging another size article requires machine shutdown, component changes and/or tricky adjustments during shutdown, and restart in trial and error fashion.

SUMMARY OF THE INVENTION

The inventive packaging machine effects, through a unique combination and arrangement, the capacity to package articles of varying sizes, including those smaller than can be accommodated by prior machines, and capable of adjustment as to article size accommodation even while the machine is in operation.

The sealing apparatus is positioned in a special fashion relative to the article conveyor belt, the belt being diverted around a rotational abutment roller that acts both in cooperation with the sealing element during the sealing stroke, and also to help support and convey articles along the belt between sealing strokes. The abutment roller presents a different surface portion to the heated sealing element with each cycle, thereby minimizing wear. The sealing components reciprocate horizontally with a carriage moving with the belt in one direction during sealing, and in reverse of the belt and articles on return, the roller rotating forwardly as it is returned rearwardly.

The vertical strokes of the upper sealing element and the cooperative lower abutment roller can be varied repeatedly and accurately during actual operation simply by turning a control crank or the equivalent a desired amount. The horizontal stroke of the carriage can be controllably varied during machine operation.

DESCRIPTION OF THE PREFERRED EMBODIMENT

Figure 1:
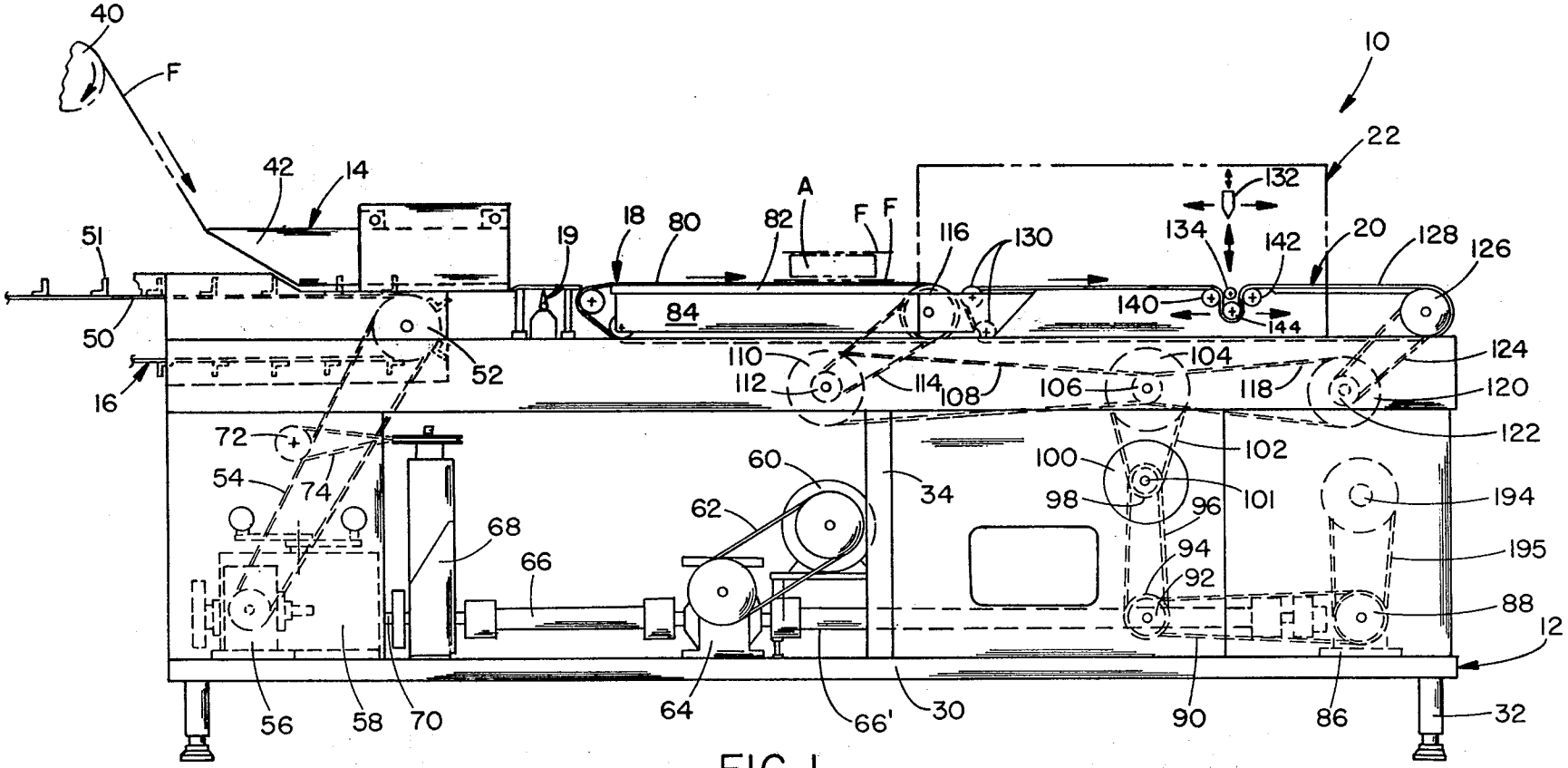
FIG. 1 is a side elevational view of the packaging machine of this invention.

Referring now specifically to the drawings, the packaging machine depicted as illustrative of the invention is an assembly 10 (FIG. 1) made up of a series of subassemblies including the framework subassembly 12 that supports the apparatus, a film web infeed and folder subassembly 14 of conventional type, an article infeed and spacing conveyor 16 which cooperates with a subsequent web plus article vacuum infeed conveyor 18, a seal and feed out conveyor subassembly 20, and a transverse joining or cross seal subassembly 22.

The framework 12 can be of various forms, and is shown to include a base 30 with legs 32 and upstanding skeletal support members 34 to support the various other subassemblies and drive mechanisms therefor.

The film infeed and folding subassembly 14 also is of conventional type, including a suitable supply 40 of film F advanced to a conventional folder 42 which, in the instance shown, causes the uniplanar web to be folded to form a pair of upper and lower panels or layers. The edges of the two panels are preferably overlapped for connection to each other as by electrostatic techniques, thermal techniques or other. (Instead of the two layers being formed from a single sheet, the web stock fed into the packaging apparatus may be in the form of two independent layers or panels.) The folder 42 is arranged relative to the article infeed conveyor 16 such that the articles are automatically advanced between the two panels of web stock as they are moved to the subsequent conveyor 18, all in conventional fashion.

Article infeed conveyor 16 is shown to include an endless drive element 50 such as a chain, a belt, or the like, preferably with a plurality of pusher elements or lugs 51 at equal spaced intervals thereon for advancing articles at predetermined intervals. These are preferably quick change lugs to allow the spacing of these lugs to be adjustable for accommodating particular article sizes. Conveyor element 50 feeds articles to the vicinity of the folding mechanism 42, being advanced around a pair of end pulleys or rollers 52 here shown to be driven by an endless drive member 54 from a gear box 56. The gear box is drivingly connected with a transmission 58 which enables the infeed conveyor to be operated at selected speeds to accommodate the particular size of articles being packaged. The power drive from the electrical motor 60 to the gear box 58 includes an endless drive member 62 to gear box 64, in turn driving shaft 66 to a phase variator 68 which allows the article infeed conveyor to be adjusted to be in phase with the other components of the apparatus. Phase variator 68 has an output shaft 70 to the transmission 58. It also is controlled from a manually operable control element 72 to an endless drive member 74 for manual phase adjustment.

After each of articles A (of which one is shown in phantom between a pair of web panels in FIG. 1 for illustrative purposes) is advanced between the two panels of the film or web stock, the overlapping longitudinal edges of the web stock are preferably joined in conventional fashion as for example at the bottom or side edge of the articles. This may be by use of a conventional electrostatic device 19 to cause a clinging type joining or a conventional thermal mechanism to fuse them (not shown). If the film stock is formed of two independent webs, two longitudinal joints should be made. Typically the film or web stock F is one of several thermoplastic polymeric materials to accommodate heat sealing of the two layers together during the packaging operation. The material may or may not be heat shrunk subsequent to the packaging machine by passage of the article and package envelope through a heated shrink tunnel (not shown).

Conveyor 18 preferably constitutes a vacuum conveyor. That is, the endless recirculating element 80 of this conveyor is perforate, passing over a perforate platform 82 forming the top of a vacuum chamber 84, so that the film stock passing thereover is drawn tightly down against the conveyor belt 80 for assured positive advancement of the film stock and articles thereon. Conveyor element 80 is also illustrated as powered by motor 60 through a drive train which includes drive belt 62, gear box 64, drive shaft 66', gear box 86 to output pulley 88 which drives endless drive element 90 to stub shaft pulley 92, with the output pulley 94 from this stub shaft operating drive element 96 to pulley 98 which in turn operates variable pitch pulley 100 on the same shaft, to drive element 102 to variable pitch pulley 104. The relative speed ratios of pulleys 100 and 104 may be adjustably changed by knob 101. The output from the shaft on which pulley 104 is mounted includes a pair of pulleys 106, one of which drives the endless drive element 108 to conveyor 18 and the other of which drives an element to conveyor 20 (to be described). Element 108 drives pulley 110 on the same shaft as pulley 112 which drives endless element 114 to the power roller 116 of the conveyor belt 80.

As noted, conveyor 20 is driven through this same basic drive train except that at pulleys 106, a separate drive element 118 operates pulley 120 on the same shaft as pulley 122 to operate endless element 124 to the drive roller 126 of conveyor 20. Specifically, conveyor 20 includes an endless recirculatory belt 128 or series of adjacent belts advanced around the power roller 126 on one end, and a pair of idlers 130 on the opposite end. This belt 128 cooperates in a special fashion with respect to the transverse joining subassembly, i.e. cross seal subassembly 22 largely shown by a phantom line box in FIG. 1 and shown more specifically in the other figures.

The components of this cross seal subassembly 22 include upper heated element 132 bascially in the form of a dull edged blade, and a lower abutment roller 134 having a basically cylindrical configuration and cooperative with the heated element 132 by forming the abutment or anvil surface therefor to join a pair of films therebetween. Both of these components are elongated in the direction transverse to the direction of travel of the articles and web stock, are parallel to each other, and reciprocate vertically together and apart, for forming the periodic transverse seals between the articles. Abutment roller 134 also performs another function in relationship to article advancement as a result of its particular positioning and interaction with endless conveyor belt 128 and three specially positioned rollers cooperative with belt 128. Two of these rollers 140 and 142 are spaced laterally apart an amount slightly greater than the width of abutment roller 134 plus twice the thickness of the belt 128, with the axes of these two rollers being parallel to each other and to the axis of the abutment roller 134, and the upper surface of these rollers being at the plane of advancement of the belt 128. The belt surface is basically coplanar with the upper surface of abutment roller 134 in its lowermost position. The abutment roller is straddled by these two rollers 140 and 142. Lying directly below the abutment roller is the third roller 144, positioned to both engage the lower surface portion of the lowered abutment roller for driving it when in engagement therewith and also being positioned such that, in cooperation with rollers 140 and 142, roller 144 causes the endless belt 128 to be diverted momentarily from the plane of its advancement, downwardly around and spaced from abutment roller 134, to form a space between rollers 140 and 142. The abutment roller, when lowered, is positioned in this space.

Figure 3:
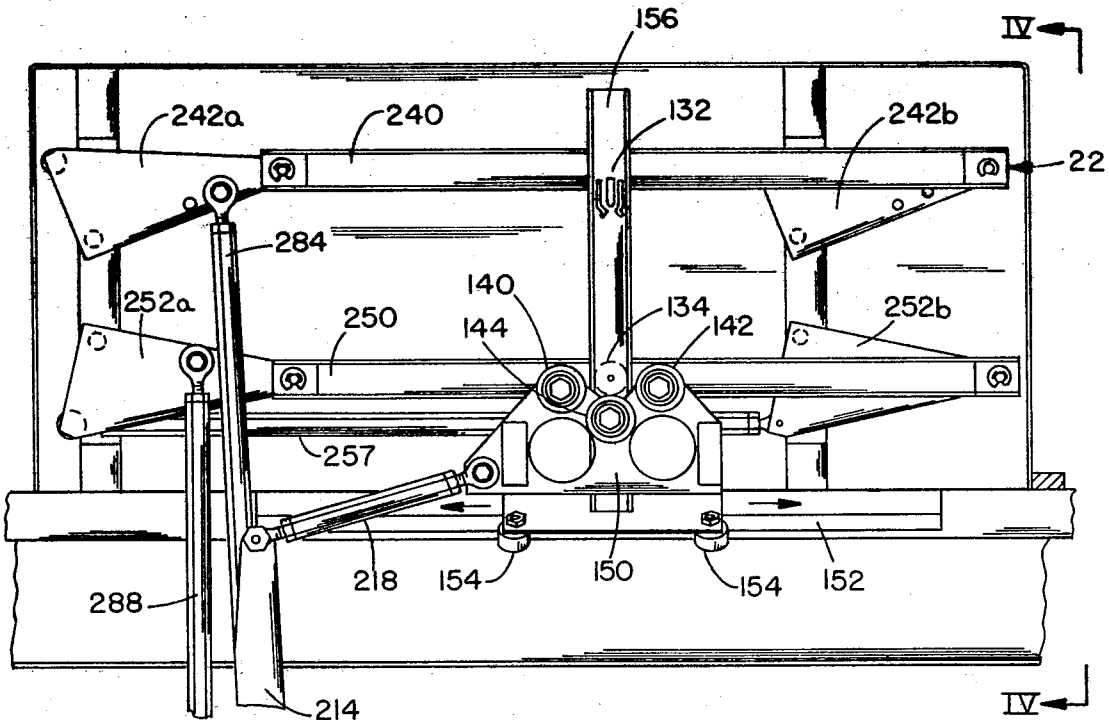
FIG. 3 is a fragmentary enlarged elevational view of a portion of the apparatus in FIGS. 1 and 2 showing the carriage and also the shiftable guide tracks for the cross seal mechanism.
Figure 4:
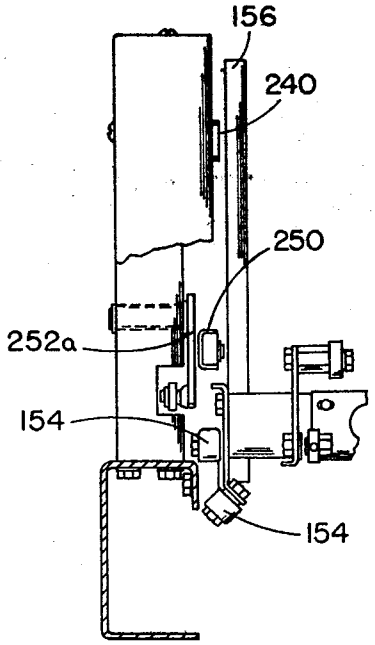
FIG. 4 is a fragmentary end elevational view of a portion of the apparatus in FIG. 3 viewed from the direction IV—IV.
Figure 6:
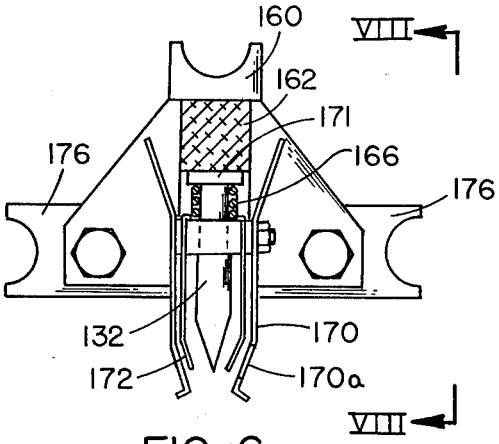
FIG. 6 is an enlarged elevational view of the upper component of the cross seal mechanism, namely the heated element and its support.
Figure 7:
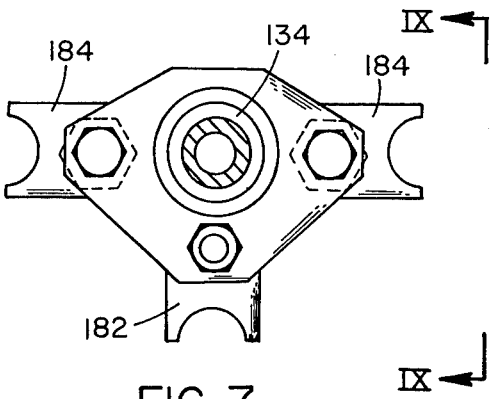
FIG. 7 is an end elevational view of the lower component of the cross seal mechanism, namely the abutment roller and its support.
Figure 8:
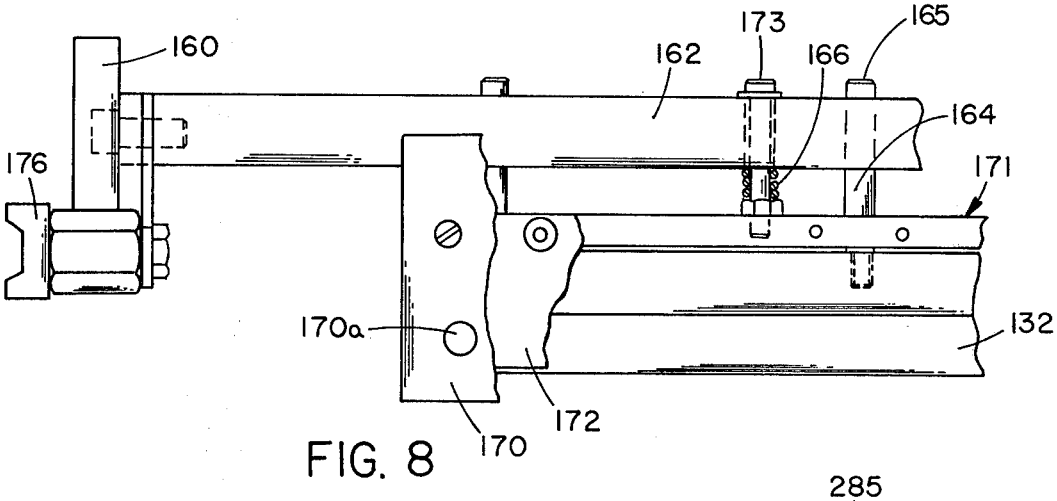
FIG. 8 is a fragmentary elevational view of the apparatus in FIG. 6, taken from the direction VIII—VIII.

All three of rollers 140, 142 and 144 are mounted at their opposite ends on a special horizontally reciprocatory carriage 150 (FIG. 3) which has a pair of support components on opposite sides of the conveyor. Each of these support components is mounted to move along a horizontal guide track 152 via guide and retention rollers 154 so that the carriage can be moved back and forth in reciprocating fashion in the direction of advancement of conveyor belt 128 and then in the return reverse direction, carrying rollers 140, 142 and 144 therewith. The carriage mechanism also includes a pair of parallel, spaced, upstanding vertical guide tracks 156 (FIG. 3) on opposite sides of the conveyor and astraddle the ends of abutment roller 134. These guide tracks retain sliding support shoes on the opposite ends of the upper, elongated heated joining element 132 and the lower abutment roller joining element 134, such that these two components are also reciprocated with the carriage and roller mechanism. These two cross seal components are movable vertically and horizontally in the direction of travel of the articles and web stock in a special fashion to be described. The vertical motion is guided by the tracks 156, each track receiving one of the slide block supports or shoe supports 160 (FIGS. 6 and 8). The heated element itself 132 forming a seal bar is suspended from a support bar 162 having shoes 160 on its opposite ends (FIG. 8). The mounting of the heated element is with a plurality of sleeves 164 and screws 165 which fasten it rigidly to support 162. Straddling the heated element is preferably a pair of metallic, roll-engaging plate 170 (FIG. 6) having divergent flanges on the lower edges thereof. These flanges help to center the blade on the abutment roller. A pair of supplemental plates 172 may also be employed astraddle of heated element 132 if desired to shield the flanges from element 132 and thus prevent overheating of the flanges. Plates 170 and 172 are attached to cross bar 171 which slides on sleeves 164. Bar 171 is hung from support bar 162 by screws 173 (one of which is illustrated) and urged downwardly by gravity and springs 166. During the sealing operation, the layers of film are pressed together by plates 170 prior to compression of springs 166 and prior to contact with the seal bar 132. The surfaces of elements 172 and the inner surfaces of elements 170 are shiny to reflect heat. The outer surfaces of elements 170 are black. Elements 170 also include air flow openings 170a for cooling. The lower edge of heated seal bar element 132 should be basically dull, normally being a few thousandths of an inch in width. Also attached to support bar 162 at the opposite ends thereof is a pair of horizontally extending slide shoes 176 for vertical movement as explained hereinafter.

Figure 9:
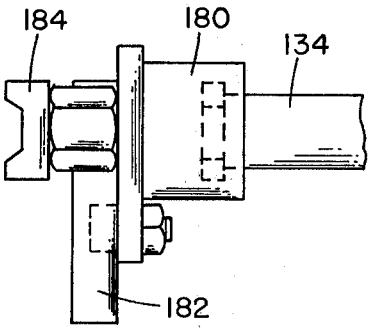
FIG. 9 is a fragmentary elevational view of the apparatus in FIG. 7, viewed from the direction IX—IX.

The abutment roller 134 is retained directly below the heated element 132, having its opposite ends rotatably mounted in bearing supports 180 (FIG. 9) to be freely rotatable. At the opposite ends of the abutment roller is a pair of vertical slide supports or shoes 182 interfitting in the lower portion of slide tracks 156. The abutment roller has a peripheral portion of a compressible material such as silicone rubber, preferably coated with "Teflon" such as "Teflon" tape or the like to allow optimum enagement of the roller with the heated element edge but without being subject to sticking of the heated web polymer. The end supports for the abutment roller also have a pair of horizontal slide shoes 184 for movement in a manner to be described hereinafter.

Figure 2:
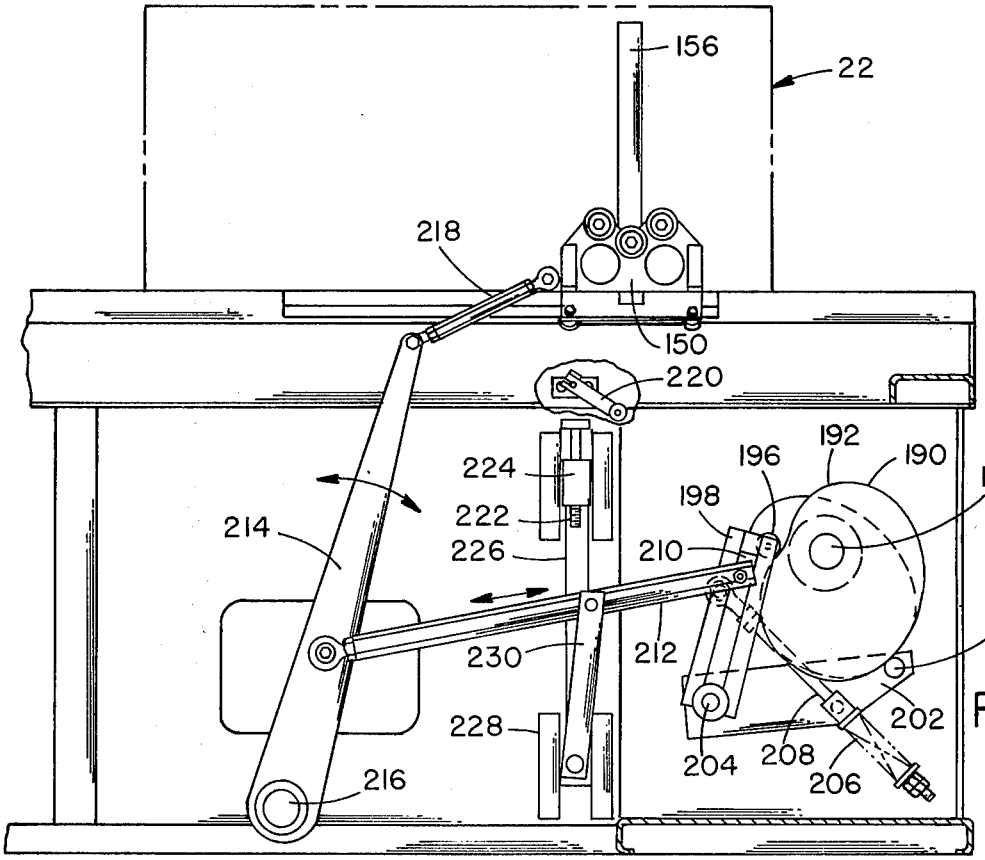
FIG. 2 is a fragmentary somewhat enlarged side elevational view of a portion of the apparatus in FIG. 1, showing the carriage horizontal stroke reciprocating mechanism.

As noted previously, carriage 150 can be reciprocated horizontally in the direction of the web and article advancement and then in a return stroke as well as being vertically shiftable. This horizontal movement is caused to occur by a drive mechanism, preferably in the form of a cam drive and linkage arrangement (see FIG. 2). The vertical movement is via another cam drive and linkage.

More specifically, the reciprocating horizontal motion of carriage 150 and the components thereon is via cam means here shown to be a pair of cooperative cams, namely operating cam 192 and auxiliary cam 190, both mounted on cam shaft 194. Cam shaft 194 is driven by a timing belt 195 (FIG. 1). Cam 190 includes a follower 196 on rocker plate 198. Cam 192 has a cam follower 200 on plate 202 pivotally mounted at axle 204 as is plate 198. These two plates 202 and 198 are biased toward each other by compression spring 206 on a tie rod 208 interconnecting them. (This pair of cams may be substituted by a closed cam with a captive track as will be obvious to those in this art.) Rocker plate 198 has an elongated track which receives a slide block 210 connected to one end of a tie rod 212, the opposite end of which is pivotally connected intermediate the ends of a reciprocating crank 214. Crank 214 is pivotally fixed at its lower end at pin 216, the upper end of the crank being pivotally connected to one end of a link 218. The opposite end of link 218 is connected to carriage 150. Thus, rotation of the cams causes reciprocation of the components and the carriage back and forth along the conveyor 20. The length of the carriage stroke can be varied by effectively adjusting the amount of reciprocation of rod 212 between the cams and the crank 214. This can be achieved by operating a hand crank 220 (FIG. 2) which changes the vertical position of the slide block 210 in the track of plate 198. More specifically, the crank operates a threaded vertical shaft 222 which engages with a collar 224 for raising and lowering support element 226 guided at its lower end by a slide track 228 and interconnected through a link 230 to the central portions of connecting rod 212. Thus, manual adjustment of crank 220 will effectively change the location of the one end of tie rod 212 relative to the cam and thereby change the amount of the tie rod stroke, to change the stroke of the crank 214 and thus of the carriage 150, to suit the particular length of the article being packaged.

As noted previously, the cross seal components comprising the heated element 132 and the abutment roller 134 are vertically movable along vertical tracks 156. This movement is achieved by the use of a pair of vertically spaced and vertically shiftable horizontally oriented slide tracks. Specifically, at the opposite sides of the conveyor 20, i.e. at the opposite ends of the heater element 132, is a pair of horizontal upper slide tracks 240 (FIG. 5), and directly below this pair of tracks is another pair of lower tracks 250 at the opposite ends of abutment roller 134. Each of these tracks is mounted on a pair of bell cranks, i.e. bell cranks **242*a* and 242*b* for tracks 240, and 252*a* and 252*b* for tracks 250. Bell cranks 242*a* and 242*b* are pivotally mounted at pivots 242' and 242" respectively on uprights 243 and 245, and are interconnected by link 247. Bell cranks 252*a* and 252*b* are pivotally mounted at pivots 252' and 252" respectively on uprights 243 and 245, and are interconnected by link 257. Thus, two pairs of bell cranks enable each track to be vertically moved while retaining its horizontal orientation. Specifically, the two spaced tracks 240 for the heated sealing element 132 can be vertically moved together to raise and lower the heated element, while the two tracks 250 for the abutment roller can be raised and lowered to raise and lower the abutment roller 134. The heated element is lowered when the roller is raised, and vice versa. The tracks 240 receive the sliding shoes 176 (FIGS. 6 and 8) of the heated element, to allow the heated element to be moved longitudinally, i.e. horizontally along the track with or without vertical movement of the heated element by sliding of shoes 160 in the vertical tracks 156. Likewise, the supports for the abutment roller 134 include horizontal shoes 184 interfitting in tracks 250 to allow sliding longitudinal, i.e. horizontal movement of the abutment roller along the tracks with or without vertical movement by sliding of shoes 182 in tracks 156**.

Figure 5:
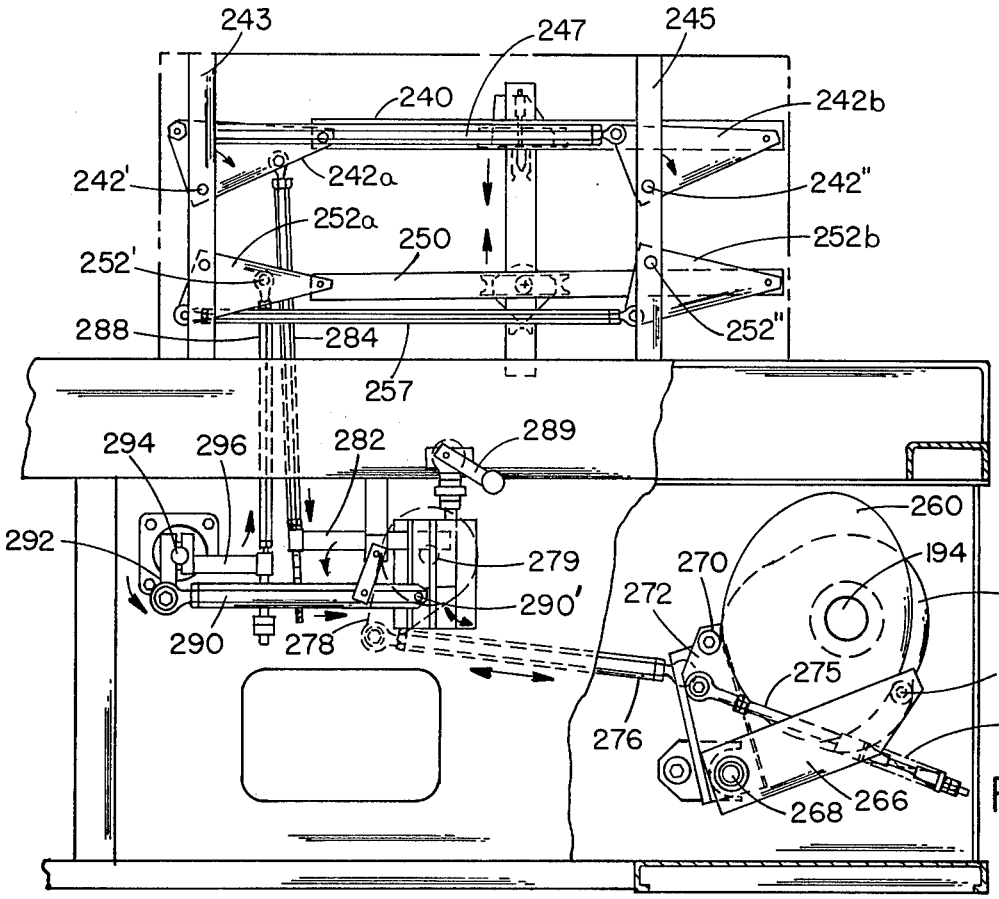
FIG. 5 is a fragmentary elevational view of a portion of the apparatus in FIG. 1, showing the vertical motion operating mechanism for the guide track mechanism in FIG. 3.
Figure 12:
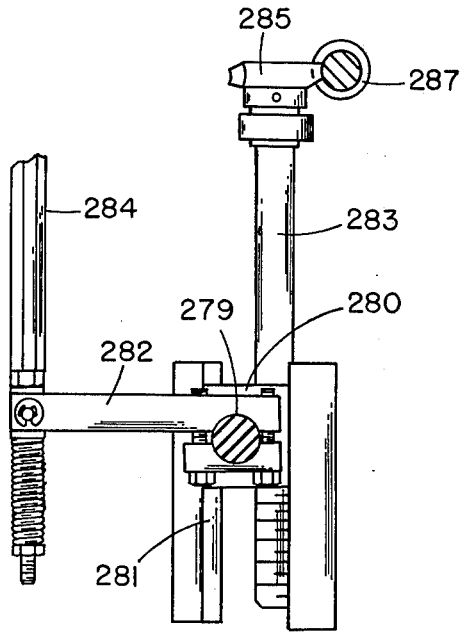
FIG. 12 is a fragmentary enlarged elevational view of a portion of the apparatus in FIG. 5.
Figure 10:
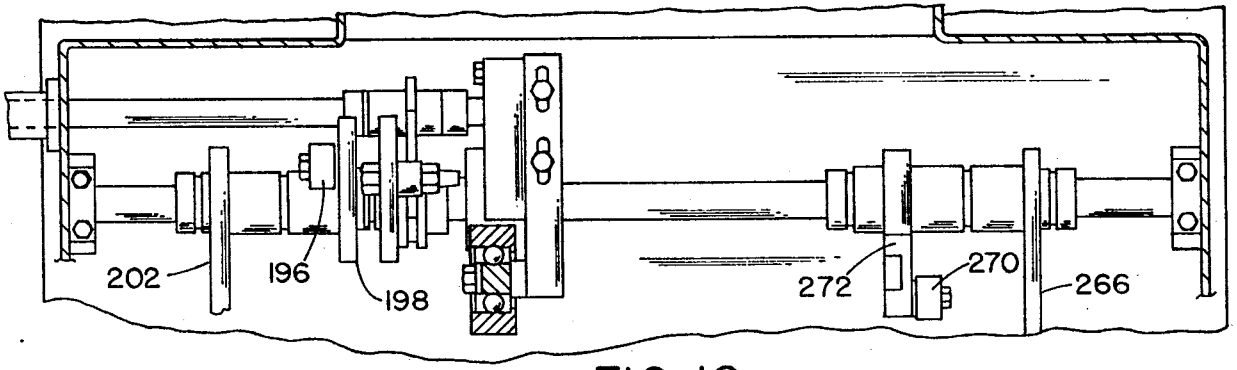
FIG. 10 is a fragmentary plan view of a cam follower mechanism for the packaging machine.

The vertical movement of the tracks 240 and 250 is through a cam driven assembly (FIG. 5), the upper tracks being lowered simultaneously with raising of the lower tracks, and vice versa, to cause the heated element and the abutment roller to be brought into sealing relationship against a pair of film layers or panels therebetween, and then to be separated vertically for the return stroke during which an article passes between them. These pairs of tracks are shown to be operated by a pair of cams 260 and 262, one for moving the tracks in one direction and the other for returning them. (This pair of cams could also be substituted by one closed cam.) Operating cam 260 and auxiliary cam 262 are mounted on cam shaft 194. Cam 260 has a cam follower 264 on a plate 266 pivotally mounted on shaft 268. Cam 262 has a cam follower 270 mounted on plate 272. These two plates 272 and 266 are interconnected by a biasing spring and rod assembly that includes coil compression spring 274 on tie rod 275 (FIG. 5) to retain both cam followers tightly against the respective cams. The two plates are also interconnected to a tie rod 276 so that the cams will reciprocate the tie rod. The opposite end of the tie rod is connected to a crank 278 on shaft 279 mounted to a slide block 280 (FIGS. 5 and 12). This slide block 280 is in a vertical track or channel 281 to be vertically movable by a threaded shaft 283 to which the block is mounted. Shaft 283 has a bevel gear 285 engaging a second bevel gear 287 operated by hand crank 289 on the same shaft. Attached to shaft 279 is a radial arm 282 connected to the lower end of the rod 284, the upper end of which is pivotally attached to bell crank 242*a*. By raising or lowering slide block 280 with crank 289, the upper and lower limits of the stroke of upper tracks 240 and heated element 132 can be varied so as to accommodate the height of the particular articles being packaged. But the amount of the stroke of tie rod 284 stays constant because of the fact that radial arm 282 pivots about the axis of shaft 279 in all adjusted positions. Vertical reciprocation of rod 284 therefore will cause the bell cranks to pivot about their respective mounting points 242' and 242" to vertically reciprocate the track.

Figure 14:
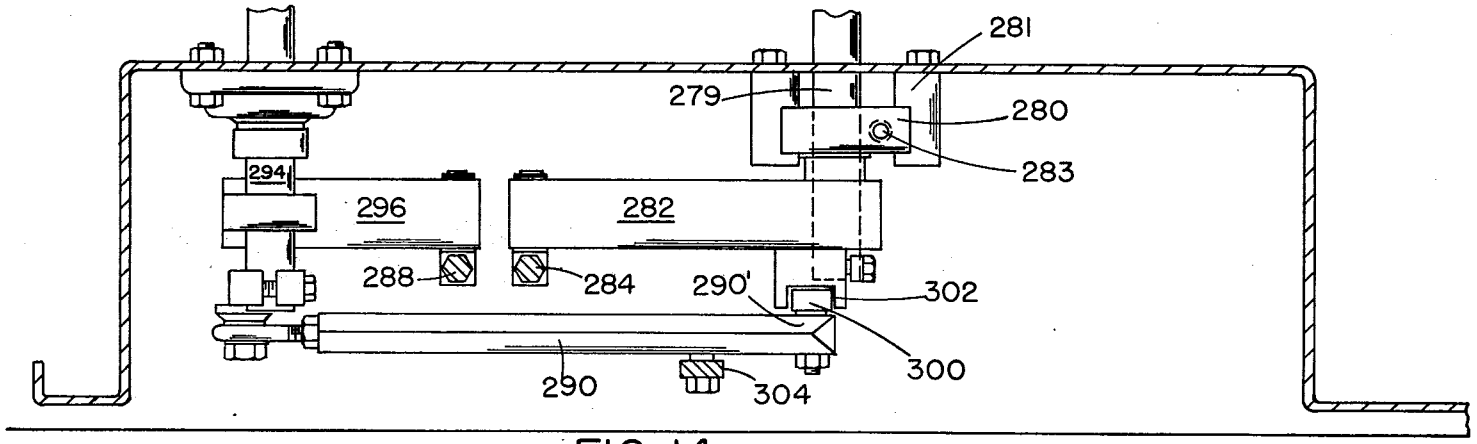
FIG. 14 is an enlarged plan view of the control in FIG. 13.

When the tracks 240 are lowered, tracks 250 are raised. This is accomplished by having tie rod 288 move in the opposite direction as tie rod 284. A linkage between block 300 and tie rod 288 causes this (FIG. 14). Specifically, a connecting rod 290 having one end attached to block 300 has its other end attached to a crank 292 that pivots on shaft 294. A radial arm 296 extending basically ninety degrees from arm 292 is connected to one end of rod 288. Thus, counterclockwise movement of the crank 278 causes radial arm 282 to be lowered, thereby lowering connecting rod 284 and tracks 240 that mount the heated element. At the same time, counterclockwise movement of crank 278 causes shifting of link 290 to the right to cause radial arms 292 and 296 to move in a counterclockwise direction thereby elevating connecting rod 288, bell cranks 252*a* and 252*b* and tracks 250 that support the abutment roller.

Figure 13:
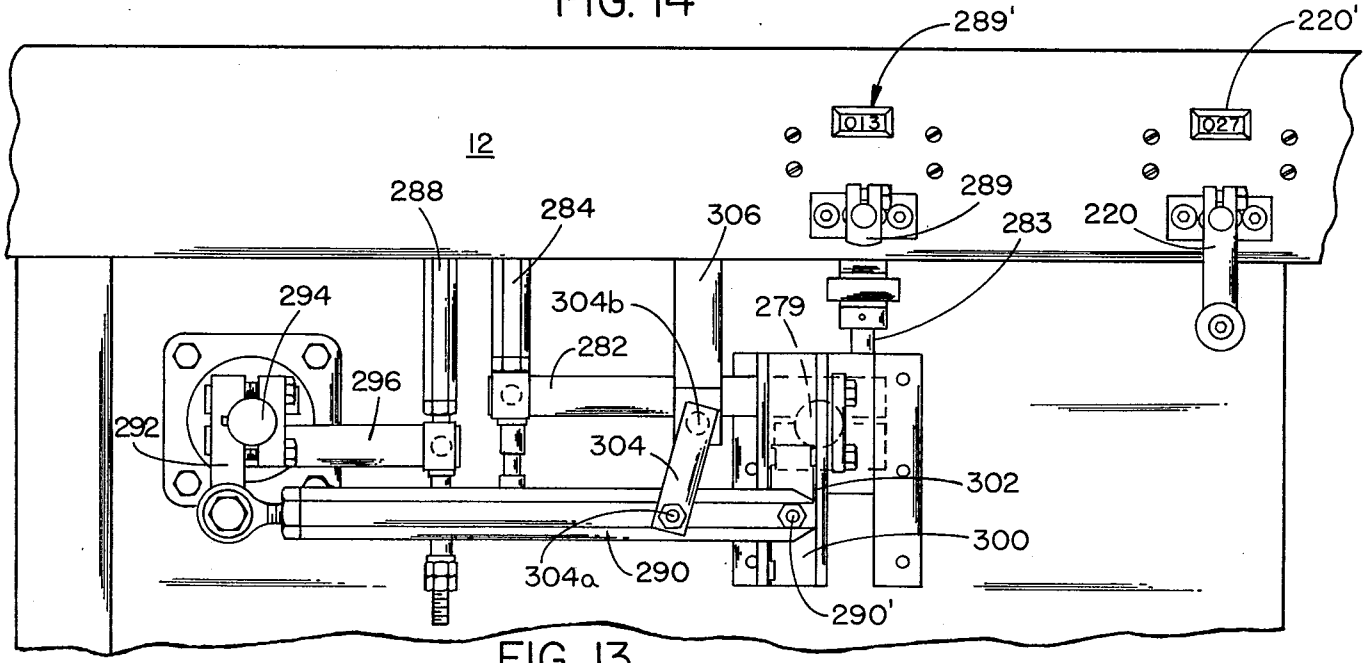
FIG. 13 is an enlarged fragmentary elevational view of the cross seal vertical motion, variable control.

The heated element and abutment roller are therefore brought together into sealing relationship at about one half the height of the article being packaged. Previously described was the mechanism for varying the upper and lower limits of the upper tracks and heated element. When this stroke is adjusted, the stroke of the lower tracks and abutment roller are also automatically simultaneously adjusted by the linkage provided, so that the abutment roller, which always returns down to the same lowermost position at the plane of advancement, moves up to a different uppermost position cooperative with the lowermost position of the heated element, i.e. about one half the article height above the belt. That is, the amount of the vertical stroke of the abutment roller varies. This is achieved by varying the amount of linear stroke of rod 290 by varying the distance between its end 290' from the axis of pivot shaft 279. This is done by keeping end 290' in the same vertical position while lowering shaft 279 closer to it to shorten the stroke or raising shaft 279 further from it to lengthen the stroke. End 290' is attached to a slide shoe 300 which is in a vertical track 302 that allows shoe 300 to move vertically while restraining it laterally of the shoe, i.e. longitudinally of the conveyor. Track 302 is attached to shaft 279 (FIGS. 13 and 14) to arcuately oscillate when the shaft is arcuately oscillated by crank 278. This reciprocates rod 290 back and forth. End 290' of rod 290 is held up by pin 304*a* of a link 304 pivotally suspended at 304*b* from mount 306 in turn attached to the framework 12.

Therefore, as the crank 289 is rotated to lower the block 280 and thereby lower shaft 279 which lowers the uppermost and lowermost positions of the constant stroke heated element 132, the shaft 279 will also approach more closely the end 290' of rod 290. This decreases the stroke length of tie rod 290 for the same amount of oscillation of crank 278 and slide 302.

The lowermost position of the abutment roller remains constant so that its upper surface is in the plane of the bottom of the advancing package and so that its lower surface is driven by roller 144. The uppermost position of the abutment roller when elevated is controllably positioned to be approximately one-half the height of the particular article to be wrapped. Too high a position of the roller during sealing will cause the article to be lifted and cause loose film on top of the article. Too low a position of the roller during sealing will put excess strain on the seal and will cause loose film on the bottom of the article.

The seal bar in its lowered position must always meet the abutment roller when the abutment roller is in its uppermost position. And the seal bar must also always rise high enough in its elevated position to clear the package on the return stroke. The mechanism just described meets all of these three requirements by means which allows adjustment through the height range (normally 0" to 4") by means of a single crank means 289.

Initial set up is as follows:

Crank 278 is turned fully clockwise, whereby slide 302 is oriented vertically so that change of position of shaft 279 causes no motion of rod 290. Abutment roller is in its lowermost position at this point which hence does not change with change of shaft 279 location. When crank 278 is fully counterclockwise, slide 302 is rotated to the right. When shaft 279 is adjusted so that its center is colinear with rod 290, oscillation of shaft 279 does not cause any motion of rod 290 and hence abutment roller 134 does not rise. As shaft 279 is raised from the point just described, end pivot 290' will be displaced to the right since slide 302 is no longer in its vertical orientation shown in FIG. 13. The abutment roller is raised through cranks 292, 296 and bell crank 252.

At the same time as shaft 279 is raised to ring the top position of the abutment roller to about one-half the article height, the lower position of seal bar will be raised through rising of crank 282, rod 284 and bell crank 242*a*. The amount of horizontal displacement of connecting rod 290 at the maximum counterclockwise rotation of slide 302, proportioned by cranks 292, 296 and 252, is made to cause the same displacement of the lower abutment roller as that of the seal bar caused by crank 282, rod 284 and bell crank 242*a*. hence, this equal amount of vertical movement of these cooperative elements results in constant sealing pressure being maintained throughout any adjustment for package height. A counter indicator 289' geared to adjustment crank 289 is conveniently provided to allow resetting at indicated values to reduce set up time for articles that have been wrapped previously.

Keeping the lowermost position of the abutment roller constant, so that its upper surface is in the plane of advancement of the articles, allows it to always be able to assist in supporting and advancing articles. Yet, it is always cooperatively positioned relative to the variable stroke upper heated element.

Products of different length must be spaced apart on the film web uniformly and with sufficient space between them to allow the seal bar and abutment roller to fuse and melt the film without crushing the product. To do this, product feed lugs A (FIG. 1) are spaced on infeed conveyor chain 50 slightly more than the length of the film pouch to be produced. Gear box 58 is set to produce one lug at the selected spacing for each reciprocation of the seal bar mechanism.

Figure 11:
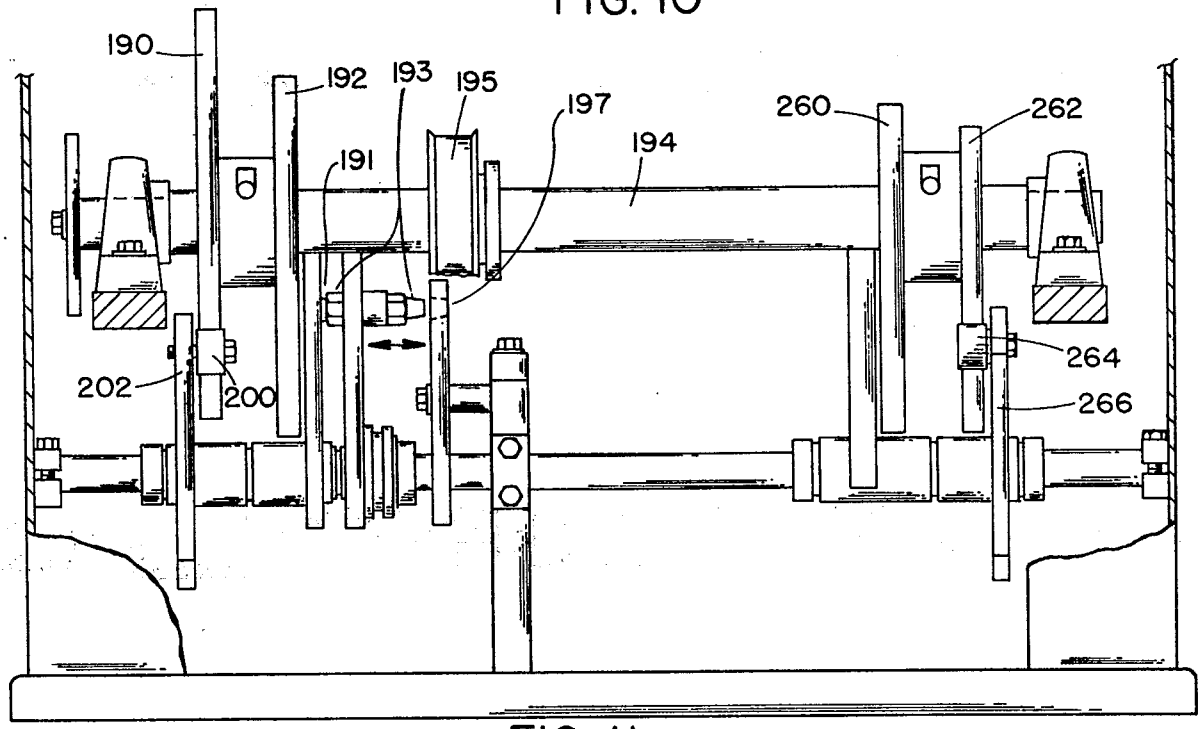
FIG. 11 is a fragmentary end elevational view of cam and cam shaft mechanism for the packaging machine.

During set up of the machine, vertical motion of the seal bar is disengaged to prevent product damage. This is done by shifting drive pin 193 from it soperating position in hole 191 on cam follower arm to the "hold open" position on support at 197 (FIG. 11).

A folder 14 suitable for the product cross section is mounted in place and film and product are then fed in. As product is carried by the film and conveyor, the amount of film fed per cycle and hence pouch length is adjusted with knob 101 on variable pitch pulley 100.

Longitudinal stroke length of carriage 150 is then adjusted with crank 220 so that the forward feed of the carriage basically equals the forward feed of the carriage basically equals the forward feed of belt or belts 128, in which condition the rollers 140, 142, 144 do not rotate during the forward or sealing stroke of the seal mechanism. An indicator counter 220' provides a setting for this stroke on repeat runs of the same product. On these repeat runs, the speed setting procedure is preferably reversed for ease of set up. That is, crank 220 is set using counter 220' and the conveyor speed is matched with knob 101. This procedure is advantageous as no product needs to be run to set up the machine.

Conveyor 20 is arranged to run slightly slower than vacuum conveyor 80 so that a slight relaxation of film web occurs between articles to enable joining of the film thereat without undue web tension. The speed ratio between conveyors 20 and 80 can be adjusted with substitution of quick change sprockets to cause conveyor 20 to run progressively slower as the height of packages is increased. This relaxation of film reduces stress on the newly made film seals, permitting a higher operating speed.

Articles are then adjusted to be in phase by control element 72 so that the seal bar matches the open space between articles. Then vertical motion of seal bars is re-engaged (193, 191, 197 FIG. 11) and production begins.

In operation of the apparatus, the upper and lower panels of web stock are advanced with articles at spaced intervals therebetween. The web panels are longitudinally secured together by electrostatic unit 19 to cause them to cling together. The articles and web panels are advanced along vacuum conveyor 18 and transferred to conveyor 20. At the spaced intervals between articles, the heated element 132 lowers and abutment roller 134 rises, simultaneously to engage the web panels at intervals between articles. At each stroke, these elements advance with the article and web panels along conveyor 20, fusing the panels together while advancing. Since the elements advance with the conveyor belt, roller 134 will not be rotated. Element 132 and roller 134 then separate when further downstream of the conveyor, with element 132 rising and roller 134 lowering to its constant lowermost position, and both are moved with the carriage in reverse, straddling the succeeding article being advanced as they return. The article is partially supported and propelled by roller 134 as the latter returns, the roller then being rotated forwardly by underlying roller 144, so that even small articles will be held and propelled by the roller assisting the belt. The cycle is then repeated.

The apparatus is thus highly versatile, capable of high speed production, and of accommodating a significant range of article sizes with short change-over time. Operation of a single crank or the equivalent allows complete adjustment of the vertical position of the sealing function without disturbing the pressure between the sealing elements.

Typically, packaging machinery exposes the articles being enveloped to potential damage, as when the sealing components are out of phase and the like. And even the sealing components themselves can be damaged in conventional units. The novel apparatus has special features rendering it relatively free of these disadvantages. Specifically, if heated seal bar element 132 is prevented from lowering, as by striking an article, spring 274 (FIG. 5) will compress to take up the cam stroke. And, if lower roller element 134 is prevented from rising, spring 206 (FIG. 2) will compress to take up the cam stroke. Also, crank 278 (FIG. 5) can be provided with an overload throw out mechanism if spring 274 cannot accommodate all of the stroke.

Further a spring loaded electrical switch can be provided on the shaft for pulley 52 (FIG. 1) if the infeed conveyor jams.

And, as mentioned previously, the throw out clutch at 191, 193 and 197 (FIG. 11) allows set up without the sealing elements being vertically reciprocated so that they remain spaced apart. In fact , the machine enables almost all adjustments in set up to be made for repeat product sizes without the product even being fed, with the indicators on shafts 220 and 289 together with the gear box being particularly useful in this regard.

The illustrative apparatus depicted employs a horizontal direction of article and film advancement, the cross seal components extending transversely horizontally thereto and being vertically reciprocable and horizontally reciprocable in the forward and reverse directions relative to feed. It is possible in some instances for these to be altered somewhat without changing the concept presented. However, these terms are used in the specification and claims for convenience and ease of understanding. Furthermore, although a specific preferred embodiment is described in detail, it will be apparent to those in the art that various alternative component mechanisms can be employed within the inventive concept presented. Hence, the invention is not intended to be limited to the specific details set forth except as defined in the claims and the reasonable equivalents thereto.

The embodiments of the invention in which an exclusive property or privilege is claimed are defined as follows

1. A packaging machine comprising:

film advancing means for advancing panels of film for packaging advancing articles; article conveying belt means for conveying spaced articles and packaging film along a plane of travel; film joining means for joining panels of film together between the spaced articles, and a carriage mounting said film joining means; said film joining means including a heated element and a cooperative abutment roller, said heated element and abutment roller being reciprocable toward and away from each other, transversely of said plane of travel, between a spaced relationship allowing articles to be advanced therebetween, and an abutment relationship on film panels for joining the panels between the spaced articles; the upper surface of said abutment roller being at said plane of travel when in said spaced relationship; a drive roller on said carriage in driving engagement with said abutment roller when the latter is in said spaced relationship, and said belt means being diverted from said plane of travel at said abutment roller to extend around a portion of said drive roller; said carriage being reciprocable along said plane of travel with said belt means to advance said heated element and said abutment roller when in abutment relationship to join the film panels, and to advance said drive roller therewith when said belt means conveys articles, and then to reverse and return said heated element and said abutment roller in said spaced relationship and return said drive roller in driving engagement with said abutment roller to cause said abutment roller to rotate forwardly as it returns.

2. The machine in claim 1 including control means for controllably altering the amount of spacing of said heated element and said abutment roller in said spaced relationship, and of the position of abutment of said heated element and said abutment roller.

3. The machine in claim 2 including guides oriented transversely of said plane of travel, first supports for said heated element engaged with said guides and second supports for said abutment roller engaged with said guides, to guide said heated element and abutment roller in relation to each other.

4. The machine in claim 3 wherein said guides are mounted to said carriage to move therewith.

5. The machine in claim 2 including:

vertical guides supported by said carriage; first supports for said heated element engaged with said vertical guides and second supports for said abutment roller engaged with said vertical guides, to allow vertical movement of said heated element and said abutment roller in aligned relation to each other; first horizontal guides oriented in the direction of said plane of travel and receiving said first supports for said heated element to allow horizontal movement thereof; second horizontal guides oriented in the direction of said plane of travel and receiving said second supports for said abutment roller to allow horizontal movement thereof; said first and second horizontal guides being vertically movable to vertically shift said first and second supports, and means for vertically moving said first and second horizontal guides to reciptocate said first and second supports and thus said heated element and abutment roller between said spaced and abutment relationships.

6. The machine in claim 1 including control means for simultaneously altering the position of abutment of both said heated element and said abutment roller.

7. The machine in claim 6 wherein said abutment roller is reciprocable between a constant position at said plane of travel when in said spaced relationship to said heated element, and a controllably varied position when in said abutment relationship.

8. The machine in claim 7 wherein said heated element is reciprocable a constant amount between a controllably varied position when in said abutment relationship and a second controllably varied position when in said spaced relationship.

9. A packaging machine for packaging articles in film stock comprising:

horizontal article conveying means for conveying spaced articles along a plane of travel; film advancing means for advancing film with articles on said article conveying means; vertically reciprocable film joining means movable vertically relative to said article conveying means for joining vertically relative to said article conveying means for joining film stock between articles on said article conveying means; said film joining means comprising an upper transverse element and a cooperative lower transverse element, said elements both being vertically reciprocable in strokes from a spaced relationship above and below said plane of travel to an abutment relationship on film stock therebetween to join the film stock between articles; and a stroke adjusting control means operably connected to both said upper and lower elements for simultaneously altering the vertical positions of both said elements in said abutment relationship to accommodate articles of differing sizes, while still maintaining the same position of said lower transverse element when in said spaced relationship; a horizontally reciprocable carriage mounting said film joining means and movable longitudinally of said conveying means in the direction of article and film advancement for advancing said film joining means with article advancement and then reversing to return for another stroke; said lower element being an abutment roller; said article conveying means including an article supporting recirculatory belt; and including a drive roller drivingly engaging said abutment roller; said upper and lower elements and said drive roller being reciprocable with said caarriage; said belt being diverted temporarily from said plane of travel at said abutment roller and drivingly engaging said drive roller to cause said abutment roller to rotate forwardly with reverse movement of said carriage.

10. A packaging machine for packaging articles in film stock comprising:

horizontal article conveying means for conveying spaced articles along a plane of travel; film advancing means for advancing film with articles on said article conveying means; vertically reciprocable film joining means movable vertically relative to said article conveying means for joining film stock between articles on said article conveying means; said film joining means comprising an upper transverse element and a cooperative lower transverse element, said elements both being vertically reciprocable in strokes from a spaced relationship above and below said plane of travel to an abutment relationship on film stock therebetween to join the film stock between articles; and a stroke adjusting control means operably connected to both said upper and lower elements for simultaneously altering the vertical positions of both said elements in said abutment relationship to accommodate articles of differing sizes, while still maintaining the same position of said lower transverse element when in said spaced relationship; a horizontally reciprocable carriage mounting said film joining means and movable longitudinally of said conveying means in the direction of article and film advancement for advancing said film joining means with article advancement and then reversing to return for another stroke; vertical guides on said carriage for said upper and lower elements for retaining said elements in vertical alignment, and said drive means including horizontal tracks for said elements, oriented longitudinally of said conveying means, said horizontal tracks being vertically shiftable for said vertical reciprocation of said elements while guiding said elements during said longitudinal movement.

11. The machine in claim 10 wherein said lower element is an abutment roller; said article conveying means includes an article supporting recirculatory belt; and including a drive roller drivingly engaging said abutment roller; said upper and lower elements and said drive roller being reciprocable with said carriage; said belt being diverted temporarily from said plane of travel at said abutment roller and drivingly engaging said drive roller to cause said abutment roller to rotate forwardly with reverse movement of said carriage.

12. A packaging machine for packaging articles in film stock comprising:

horizontal article conveying means for conveying spaced articles along a plane of travel; film advancing means for advancing film with articles on said article conveying means; vertically reciprocable film joining means movable vertically relative to said article conveying means for joining film stock between articles on said article conveying means; said film joining means comprising an upper transverse element and a cooperative lower transverse element, said elements both being vertically reciprocable in strokes from a spaced relationship above and below said plane of travel to an abutment relationship on film stock therebetween to join the film stock between articles; and a stroke adjusting control means operably connected to both said upper and lower elements for simultaneously altering the vertical positions of both said elements in said abutment relationship to accommodate articles of differing sizes, while still maintaining the same position of said lower transverse element when in said placed relationship; and drive means operably connected for driving both said article conveying means and said film advancing means and including relative speed ratio drive elements to advance said film advancing means at a slightly faster rate than said article conveying means to provide controlled slack in the film between the articles for joining of the film.

* * * * *

UNITED STATES PATENT AND TRADEMARK OFFICE

CERTIFICATE OF CORRECTION

PATENT NO. : 4,141,196

DATED : February 27, 1979

INVENTOR(S) : Kenneth R. Blanding

It is certified that error appears in the above-identified patent and that said Letters Patent are hereby corrected as shown below:

Column 9, line 18:
"it soperating" should be ---its operating---

Column 9, lines 27 and 28:
After "feed" delete "of the carriage basically equals the forward feed of"

Column 12, lines 15 and 16:
After "joining" delete "vertically relative to said article conveying means for joining"

Column 12, lines 42 and 43:
"caarriage" should be ---carriage---

Column 14, line 21:
"placed" should be ---spaced---

Signed and Sealed this

*Twenty-fifth* Day of *September 1979*

[SEAL]

*Attest:*

*Attesting Officer*

LUTRELLE F. PARKER

*Acting Commissioner of Patents and Trademarks*